US008833856B2

(12) United States Patent
Uhlenbrock

(10) Patent No.: US 8,833,856 B2
(45) Date of Patent: Sep. 16, 2014

(54) SEATING FURNITURE, MORE ESPECIALLY OFFICE SWIVEL CHAIR

(75) Inventor: Johannes Uhlenbrock, Drensteinfurt (DE)

(73) Assignee: Steelcase Inc., Grand Rapids, MI (US)

( * ) Notice: Subject to any disclaimer, the term of this patent is extended or adjusted under 35 U.S.C. 154(b) by 359 days.

(21) Appl. No.: 13/201,530

(22) PCT Filed: Feb. 17, 2010

(86) PCT No.: PCT/EP2010/000995
§ 371 (c)(1),
(2), (4) Date: Oct. 12, 2011

(87) PCT Pub. No.: WO2010/094470
PCT Pub. Date: Aug. 26, 2010

(65) Prior Publication Data

US 2012/0019035 A1 Jan. 26, 2012

(30) Foreign Application Priority Data

Feb. 17, 2009 (DE) ..... 10 2009 009 287

(51) Int. Cl.
*A47C 1/032* (2006.01)

(52) U.S. Cl.
USPC ..... 297/300.5; 297/300.2

(58) Field of Classification Search
USPC ..... 297/300.5, 303.4
See application file for complete search history.

(56) References Cited

U.S. PATENT DOCUMENTS 4,758,045 A * 7/1988 Edel et al. ..... 297/300.2
4,986,601 A * 1/1991 Inoue ..... 297/300.4
5,224,758 A * 7/1993 Takamatsu et al. ..... 297/300.5

(Continued)

FOREIGN PATENT DOCUMENTS

CN 1242178 A 1/2000
DE 19823632 9/1999

(Continued)

OTHER PUBLICATIONS

Search Report.

(Continued)

*Primary Examiner* — Peter Brown
(74) *Attorney, Agent, or Firm* — Price Heneveld LLP

(57) ABSTRACT

A chair comprises a seat and a backrest support which are mounted on a support member, the backrest support being pivotal about a horizontal pivot axis, and an energy accumulator which is tensioned when the seat is subjected to a load and acts on the backrest support, the energy accumulator engaging the backrest support at an effective distance from the pivot axis.

To improve the efficiency of such a mechanism, the energy accumulator is connected on the one side to the support member and one the other side via a transverse connector to the backrest support.

With the mechanism the energy accumulator is subject to a load substantially by the rear region of the seat and thus substantially by the complete weight of a person sitting on the seat.

In an alternative embodiment the seat comprises an elastic cover which on the one side is clamped in the support member and on the other side is connected to the backrest support, the elastic cover serving as energy accumulator.

According to a further alternative the seat comprises a flexible cover which is connected on the one side to the energy accumulator and on the other side to the backrest support.

8 Claims, 5 Drawing Sheets

(56) References Cited

U.S. PATENT DOCUMENTS

| | | | | |
|---|---|---|---|---|
| 5,348,372 | A * | 9/1994 | Takamatsu et al. | 297/303.1 |
| 5,584,533 | A * | 12/1996 | Schrewe | 297/300.2 |
| 5,605,376 | A * | 2/1997 | Kogai | 297/300.5 |
| 6,234,573 | B1 | 5/2001 | Roder et al. | |
| 6,238,000 | B1 * | 5/2001 | Hallmark et al. | 297/300.5 |
| 6,523,896 | B1 * | 2/2003 | Uhlenbrock | 297/300.4 |
| 6,709,056 | B2 * | 3/2004 | Bock | 297/300.4 |
| 7,850,237 | B2 * | 12/2010 | Gorgi | 297/303.1 |
| 2005/0116527 | A1 | 6/2005 | Leguen et al. | |

FOREIGN PATENT DOCUMENTS

| | | |
|---|---|---|
| DE | 60221793 | 6/2007 |
| DE | 202006005645 | 8/2007 |
| DE | WO2007110729 | 10/2007 |
| EP | 0277474 | 8/1988 |
| EP | 1358821 | 11/2003 |
| EP | 1353584 | 8/2007 |
| GB | 550469 | 1/1943 |
| GB | 2210780 | 6/1989 |
| GB | WO02058514 | 8/2002 |
| IT | WO2009153811 | 12/2009 |
| NL | 86123 | 8/1957 |

OTHER PUBLICATIONS

Examination Report.

* cited by examiner

SEATING FURNITURE, MORE ESPECIALLY OFFICE SWIVEL CHAIR

BACKGROUND

The invention relates to seat furniture, more especially a swivel chair having an energy accumulator.

Such a chair is known for example from DE 198 23 632 C1. In this known chair the energy or force accumulator is constructed in the form of a tension spring which on the one side engages the backrest support. In the region of the front edge of the seat a two-armed lever is pivotally secured to the support member, the one end of the two-armed lever being pivotally connected to the seat and the other end of the two-armed lever is connected to the other end of the tension spring. By a load on the seat the two-armed lever is pivoted, the tension spring thereby being tensioned and in turn biases the backrest support and the backrest in the direction towards the front edge of the seat.

The mechanism described implements the feature that the pretensioning or bias of the backrest depends of the weight of the sitting person and it is therefore not necessary to adjust the pretensioning of the backrest to the weight of the user manually.

The disclosure is based on the problem of increasing the efficiency of such a mechanism.

SUMMARY

Briefly stated, seat furniture comprising a seat and a backrest support which are mounted on a support member is pivotable about a horizontal pivot axis. An energy accumulator is tensioned when the seat is subjected to a load and acts on the backrest support. The energy accumulator engages the backrest support at an effective distance from the pivot axis. The energy accumulator is connected on the one side to the support and on the other side via a transverse connector to the backrest support.

The energy accumulator is a tension spring in one embodiment. The energy accumulator on the one side via a lever engages the backrest support and on the other side is connected via a transverse connector to the backrest support. The energy accumulator may be a compression spring. The axis of the lever extends substantially parallel to the axis of the transverse connector. The seat is articulately connected in a bearing to the transverse connector between the connection to the energy accumulator and the backrest support. The bearing is displaceable with respect to the transverse connector.

The energy accumulator, in one embodiment, is connected to the transverse connector via a deflection guide element. The bearing is arranged in the region of the rear half and preferably in the region of the rear third of the seat.

The seat may comprise an elastic cover which is clamped on the one side in the support member and on the other side is connected to the backrest support. The elastic cover serves as an energy accumulator. The seat may also comprise a flexible cover connected on the one side to the energy accumulator and on the other side to the backrest support. The effective distance at which the force accumulator engages the backrest support may be variable.

The seat furniture utilizes the knowledge that the weight of a person sitting normally subjects the seat surface of the seat to the highest load in the rear region. Thus, in the described conventional mechanism, the weight force cannot be effectively utilized because in this mechanism the loading of the energy accumulator is over the front region of the seat, that is the thigh region of the seated person.

In contrast, it is proposed that the energy accumulator engages the backrest support via a transverse connector and can therefore be arranged in the rear region of the seat and can be actuated by almost the full weight of the seated person.

The term "effective distance" here designates the effective leverage with which the energy accumulator engages the backrest support for the pivoting thereof.

The seat is preferably pivotally connected to the transverse connector by a mounting, this being done between the connection thereof with the energy accumulator and the backrest support. On a loading of the seat the transverse connector is pivoted at the backrest support and thereby tensions the energy accumulator.

The extent of the pivoting of the transverse connector depends on the position of the mounting on the transverse connector. If the mounting is made movable with respect to the pivot point the magnitude of the tensioning of the energy accumulator and thus the bias of the backrest can be adjusted.

It is not necessary here to connect the energy accumulator directly to the transverse connector; this can also be done via a suitable connecting element such as a chain, a cable or the like.

To enable the weight of the seated person to be utilized particularly effectively the mounting is arranged in the rear half, preferably in the region of the rear third of the seat.

In an alternative solution of the problem the seat comprises an elastic cover which itself serves as energy or force accumulator, the elastic cover being clamped on the one hand on the support member and on the other hand connected to the backrest support. This solution automatically fulfils the requirement that substantially the entire weight of the seated person is utilized for tensioning the energy accumulator.

This applies analogously in a further alternative in which a flexible cover which is substantially not elastic is used as seat, the flexible cover being connected to the energy accumulator in the form of a torsion rod, a torsion spring or a leg spring and on the other side to the backrest support.

In all the embodiments the action of the energy accumulator on the backrest support is dependent upon the effective distance between the pivot axis of the backrest support and the engagement point of the energy accumulator. Accordingly, on changing the effective distance the magnitude of the biasing of the energy accumulator and thus the magnitude of the bias or pretensioning of the backrest can be varied.

Depending on the concrete configuration, it is possible to use as force accumulator for example tension springs, compression springs, gas-pressure elements, torsion springs, leg springs, etc.

BRIEF DESCRIPTION OF THE DRAWINGS

Examples of embodiments of the invention will be explained with the aid of the attached drawings. These show, in each case in side elevation.

DETAILED DESCRIPTION

Figure 1:
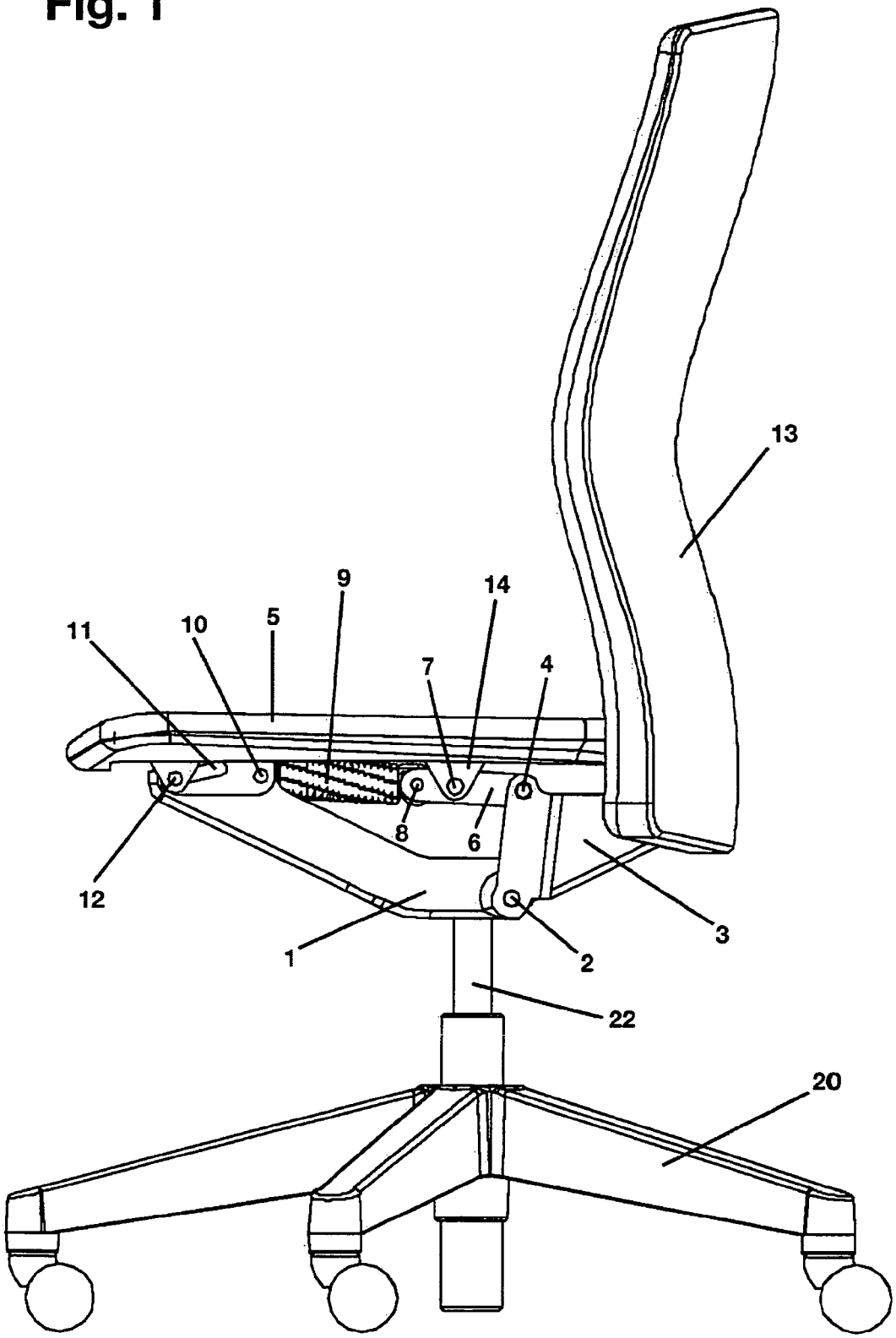
FIG. 1, a chair according to a first embodiment,
FIG. 2, a detail view of a second embodiment,
FIG. 3, a third embodiment,
FIG. 4, a detail view of a fourth embodiment, and
FIG. 5 a detail view of a fifth embodiment.

According to FIG. 1, the chair, in this case an office swivel chair, comprises in usual manner a roller cross 20 on which a chair column 22 is connected to a support member 1. In a mounting 2 a backrest support 3 is pivotally connected to the support member 1, the backrest support 3 carrying a chair backrest 13.

The support member 1 further comprises a slide way 11 in which a link guide 12 of a seat 5 is displaceably mounted.

In the front region of the support member 1 one end of a tension spring 9 is pivotally mounted in a mounting 10, the other end of the tension spring 9 being pivotally connected to a transverse connector 6 in a bearing 8. The other end of the transverse connector 6 is mounted in a bearing 4 of the backrest support. Via a lug 14 the transverse connector 6 is pivotally connected in a bearing 7 to the seat.

When a person sits on the chair, due to the weight of the person the transverse connector is pivoted via the lug 14 and the bearing 7 and tensions the tension spring 9, the tensioning of the tension spring 9 depending on the weight of the person sitting down. On the other hand, by the tension of the tension spring 9 via the transverse connector 6 the backrest support is biased, that is into the upright position of the backrest 13. The seated person can pivot the backrest 13 rearwardly, the seat 5 being correspondingly displaced via the bearing 7 (to the right in FIG. 1).

Since the pretensioning or biasing of the tension spring 9 and thus the biasing of the backrest 13 is dependent on the weight of the person sitting down, manual adjustment is fundamentally not necessary.

On the other hand, steps can be taken to additionally adjust the biasing individually manually. For this purpose for example the bearing 7 may be displaceably adjusted between the bearing 8 and the bearing 4, thereby enabling the pivot range of the transverse connector 6 to be varied. It is also possible to vary the effective distance at which the energy accumulator 9 engages the backrest support by for example providing means for varying the distance apart of the bearing 4 and 2. These additional adjustment possibilities are not illustrated in FIG. 1.

Figure 2:
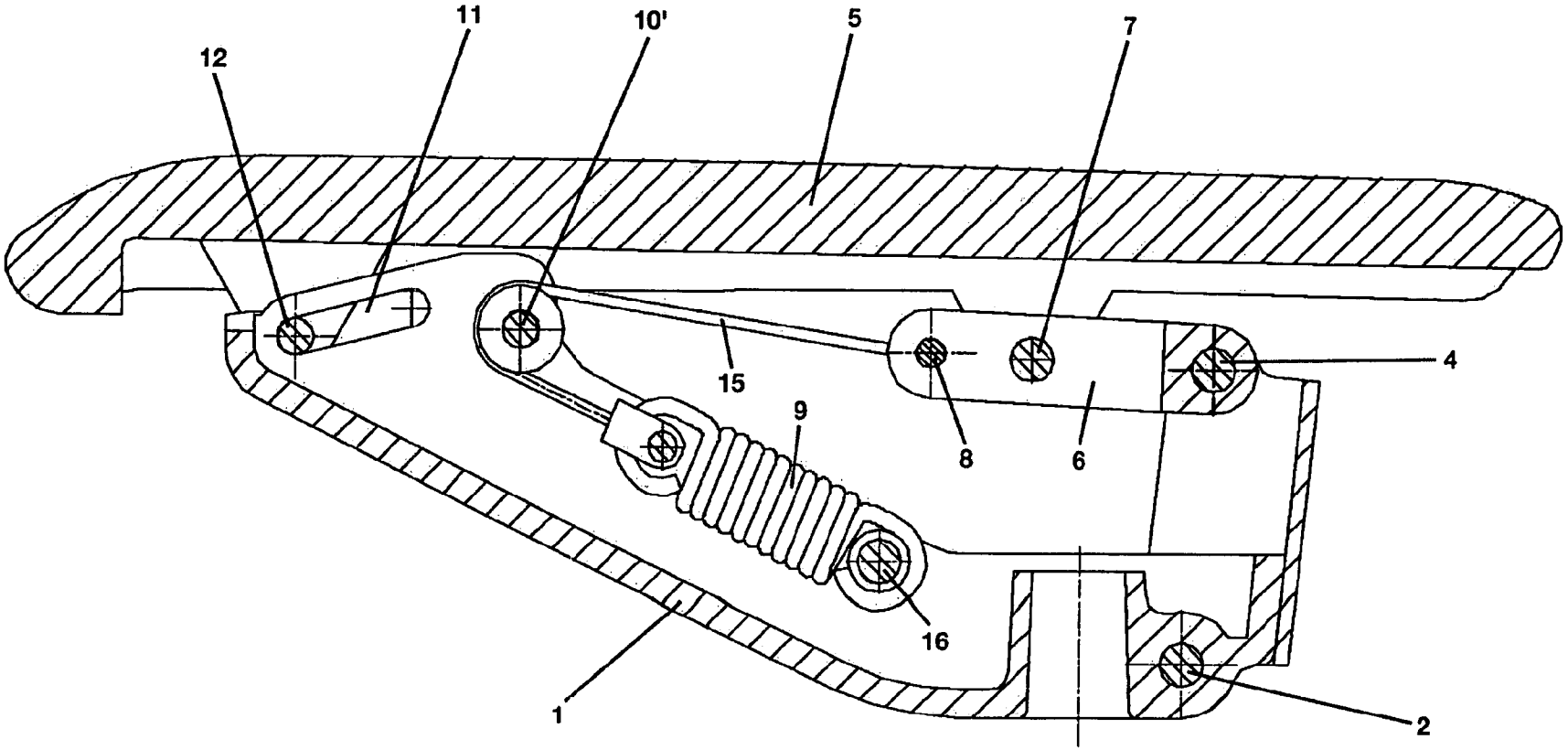

FIG. 2 shows a detail of a second embodiment, identical parts being designated with the same reference numerals.

In the second embodiment the tension spring 9 is not directly connected to the transverse connector 6 but via a connecting element 15 in the form of a cable, chain or the like which is led over a deflection guide member 10'. The one end of the tension spring is connected to the guide element 15 and the other end is connected to a mounting 16 on the support member 1. The remaining constructional components correspond to those of the first embodiment.

Figure 3:
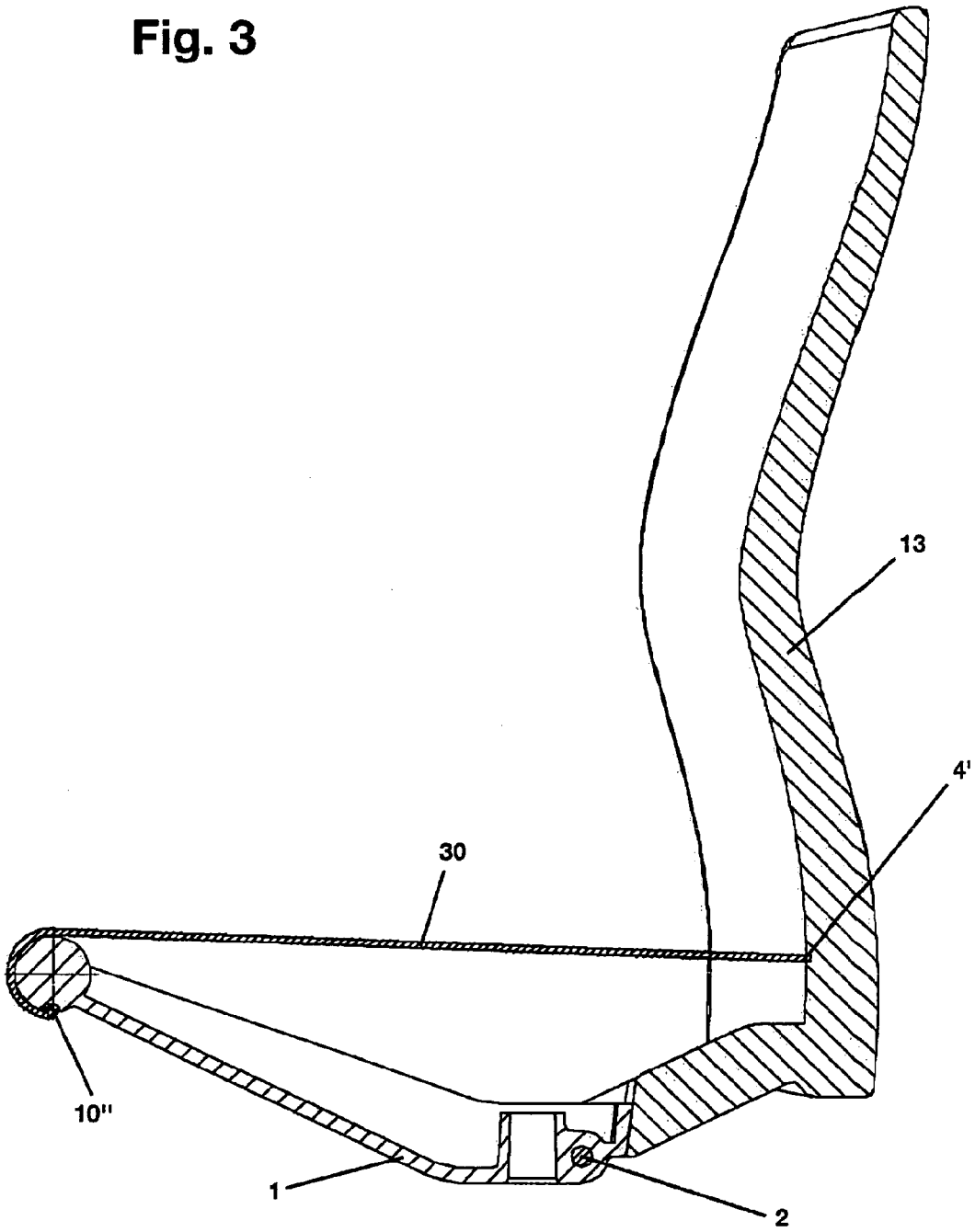

According to FIG. 3 the seat is formed as an elastic membrane 30 which is fixedly clamped at 10" on the support member 1 and is secured to the backrest 13 at 4'. Due to its elasticity the membrane 30 effects that under the load of a seated person the backrest 13 is pretensioned, thereby achieving the same effect as in the first two examples of embodiment.

Figure 4:
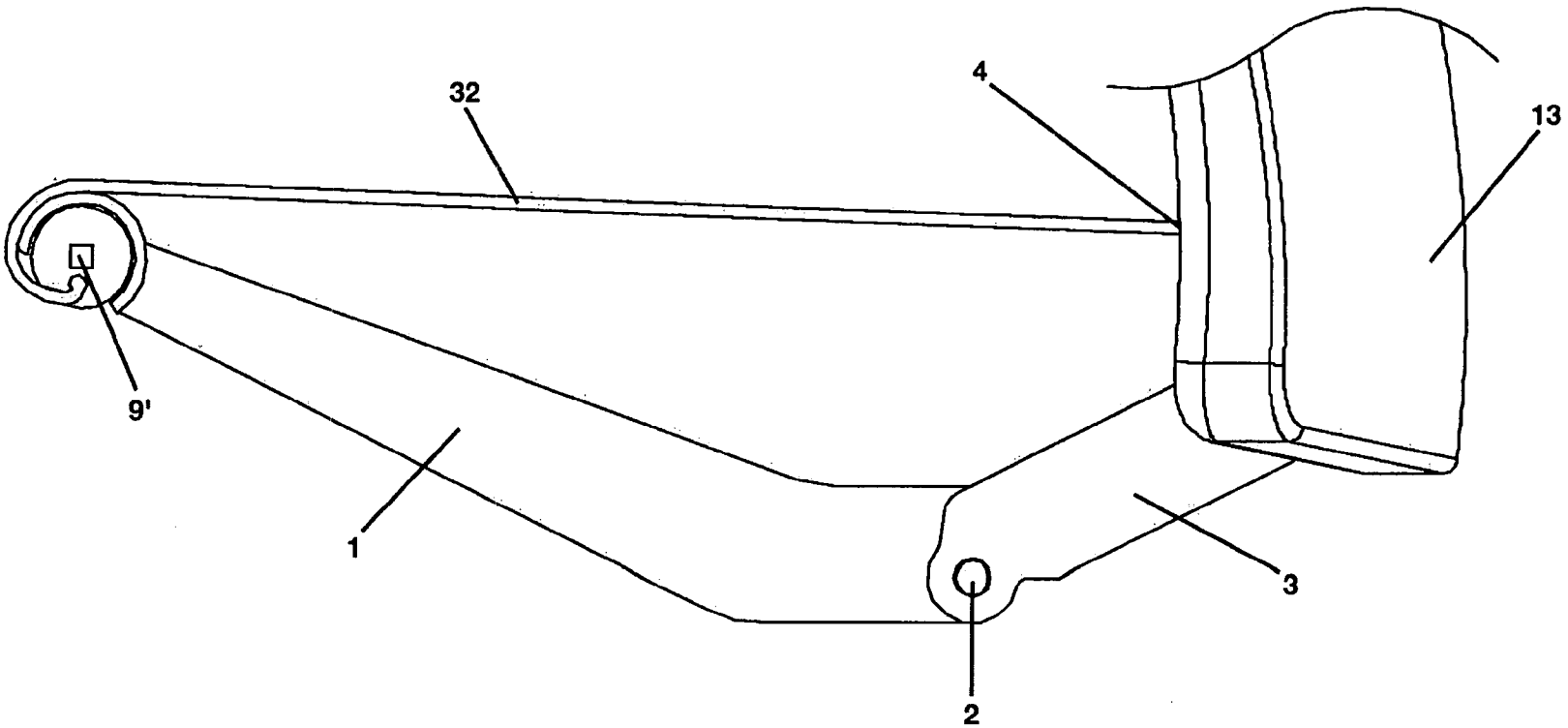

The same effect is achieved in the example of embodiment illustrated in FIG. 4; in this case the seat is formed by a substantially non-elastic cover 32 which is connected at the support member 1 to an energy accumulator 9' in the form of a torsion rod, a torsion spring or a leg spring. The cover is connected to the backrest 13 at 4' corresponding to the example of embodiment of FIG. 3.

Figure 5:
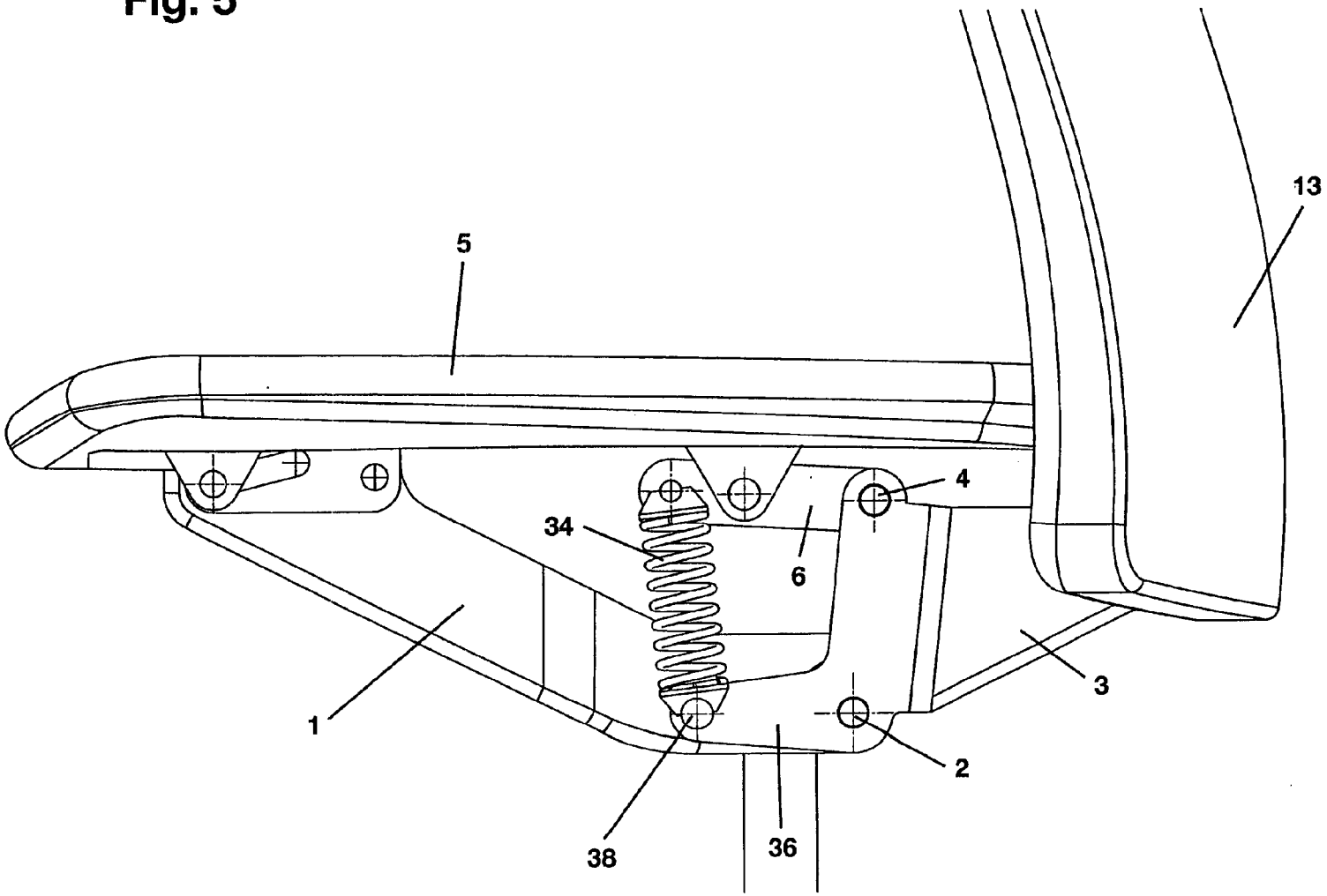

FIG. 5 shows a detail view of a fifth embodiment, the same parts bearing the same reference numerals. In contrast to the example of FIG. 1, in this case the energy accumulator is a compression spring 34 which on one side engages the transverse connector 6 and on the other side acts on the backrest support 3 via a lever means 36. In the position illustrated the lever 36 extends substantially parallel to the transverse connector 6 and forms a rigid angle lever with the region of the backrest support between the bearings 2 and 4. When the seat is subjected to a load the compression spring 34, which is articulately connected to the angle lever in a bearing 38, is subjected to compressive stress so that a force is transmitted to the lever 36 and thus to the backrest support 3 such that the counter force of the backrest is proportional to the body weight.

In addition to the adjustment possibilities already mentioned in the preceding embodiment, in this case there is the additional possibility of configuring the bearing 38 to be displaceable along the axis of the lever 36 and thereby enabling the effective length of the lever 36 to be varied, thus achieving a fundamental further possibility of adjusting the counter force of the backrest.

In the above text the definitions of "front", "rear", etc. are derived from the normal position of a chair.

It is furthermore to be noted that the backrest support and the backrest can be made integrally with each other as illustrated for example in FIG. 3 or as separate parts in accordance with FIG. 1.

In all the embodiments, the chair is constructed above the chair column substantially laterally symmetrically, and the mechanisms according to FIGS. 1 and 2 can be arranged centrally or doubled, one on each side.

It is furthermore clear that the devices and mechanisms described here can also be employed in other seat furniture, such as 4-leg chairs, armchairs, sofas and the like, and the support member can be correspondingly adapted as required.

The invention claimed is:

1. Seat furniture comprising a seat and a backrest support which are mounted on a support member, the backrest support being pivotal about a horizontal pivot axis, and an energy accumulator which is compressed when the seat is subjected to a load and acts on the backrest support, the energy accumulator engaging the backrest support at an effective distance from the pivot axis, characterized in that the energy accumulator on one side via a lever engages the backrest support and on another side is connected via a transverse connector to the backrest support, wherein the transverse connecter includes a first end operably secured to the backrest support and a second end operably secured to the energy accumulator such that the seat is operably connected to the transverse connector between the first end and the second end, such that the energy accumulator acts to increase a force required to pivot the backrest support when the load is applied to the seat.

2. Seat furniture according to claim 1, wherein the energy accumulator is a compression spring.

3. Seat furniture according to claim 2, wherein the lever has an axis and, in an unloaded state, the transverse connector has an axis and the axis of the lever extends substantially parallel to the axis of the transverse connector.

4. Seat furniture according to claim 2, wherein the seat is articulately connected in a bearing to the transverse connector between the first end and the second end.

5. Seat furniture according to claim 1, wherein the lever has an axis and the transverse connector has an axis and, in an unloaded state, the axis of the lever extends substantially parallel to the axis of the transverse connector.

6. Seat furniture according to claim 5, wherein the seat is articulately connected in a bearing to the transverse connector between the first end and the second end.

7. Seat furniture according to claim 1, wherein the seat is articulately connected in a bearing to the transverse connector between the first end and the second end.

8. Seat furniture according to claim 1, wherein the backrest support is directly pivotally coupled to the support member.

* * * * *